US007914001B2

(12) United States Patent
Herrmann

(10) Patent No.: US 7,914,001 B2
(45) Date of Patent: Mar. 29, 2011

(54) SYSTEMS AND METHODS FOR DETERMINING SKEW CONTRIBUTION IN LATERAL SHEET REGISTRATION

(75) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 195 days.

(21) Appl. No.: 12/137,982

(22) Filed: Jun. 12, 2008

(65) Prior Publication Data

US 2009/0309298 A1 Dec. 17, 2009

(51) Int. Cl.
*B65H 7/02* (2006.01)

(52) U.S. Cl. ..... 271/228

(58) Field of Classification Search ..... 271/228
See application file for complete search history.

(56) References Cited

U.S. PATENT DOCUMENTS 4,438,917 A * 3/1984 Janssen et al. ..... 271/227
4,518,862 A * 5/1985 Dorn ..... 250/559.37
4,538,905 A 9/1985 Griego et al.
4,776,027 A 10/1988 Hisano et al.
4,971,304 A * 11/1990 Lofthus ..... 271/227
5,094,442 A 3/1992 Kamprath et al.
5,169,140 A 12/1992 Wenthe, Jr.
5,528,387 A 6/1996 Kelly et al.
5,676,477 A * 10/1997 Tanaka et al. ..... 400/579
5,678,159 A 10/1997 Williams et al.
5,697,608 A 12/1997 Castelli et al.
5,715,514 A 2/1998 Williams et al.
5,848,344 A 12/1998 Milillo et al.
5,887,996 A * 3/1999 Castelli et al. ..... 400/579
5,994,711 A 11/1999 Seachman et al.
6,373,042 B1 4/2002 Kretschmann et al.
6,736,394 B2 5/2004 Herrmann et al.
6,817,609 B2 11/2004 Halvonik et al.
7,422,211 B2 * 9/2008 Dejong et al. ..... 271/249
7,472,905 B2 * 1/2009 Inoue ..... 271/227

* cited by examiner

*Primary Examiner* — Stefanos Karmis
*Assistant Examiner* — Luis Gonzalez
(74) *Attorney, Agent, or Firm* — Pillsbury Winthrop Shaw Pittman LLP

(57) ABSTRACT

This application relates to systems and methods for determining the lateral component of skew for a sheet of media. First, the skew angle of a sheet of media is determined. Then, the lateral component of the skew is determined. During a lateral registration operation, the lateral component of the skew is accounted and compensated for. In one implementation, the slope of the angle of the skew may be determined by taking the regression of the function characterizing the edge of the sheet as it passes an edge detection sensor.

23 Claims, 4 Drawing Sheets

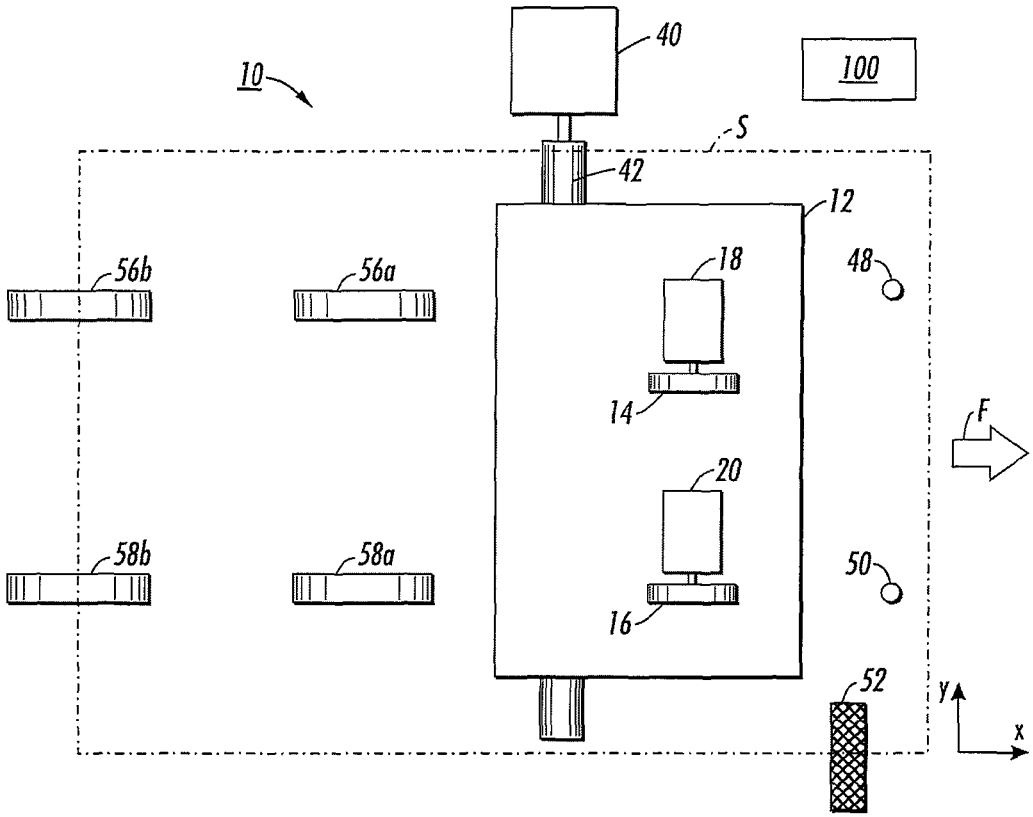
FIG. 1
FIG. 2
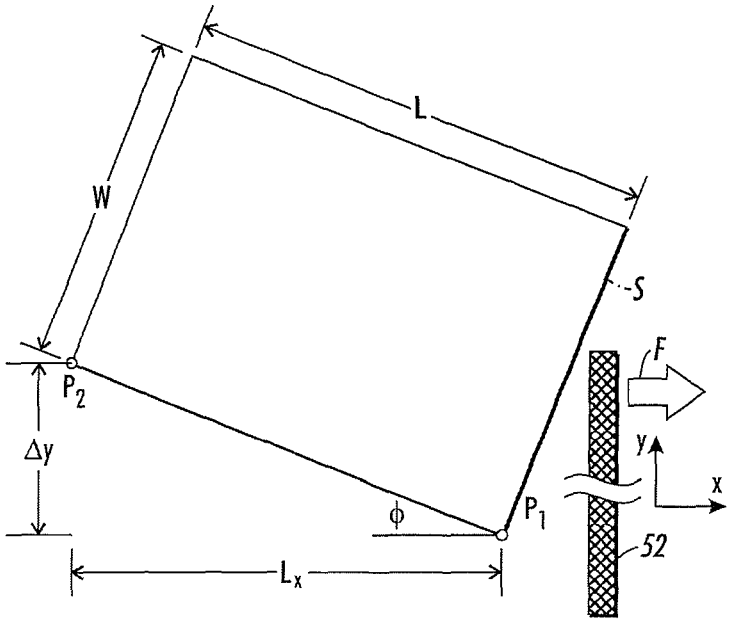

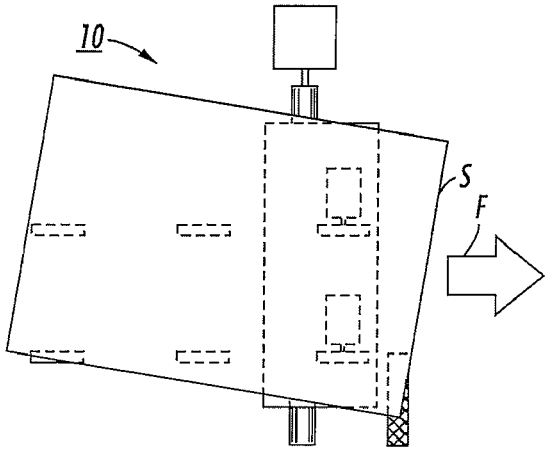
FIG. 3A
FIG. 3B
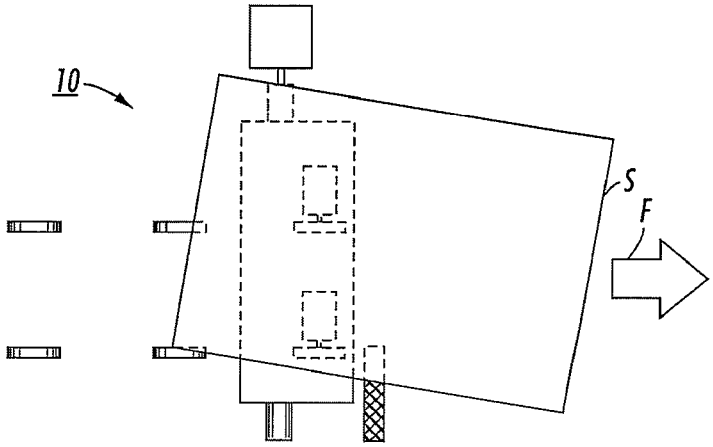
FIG. 3C
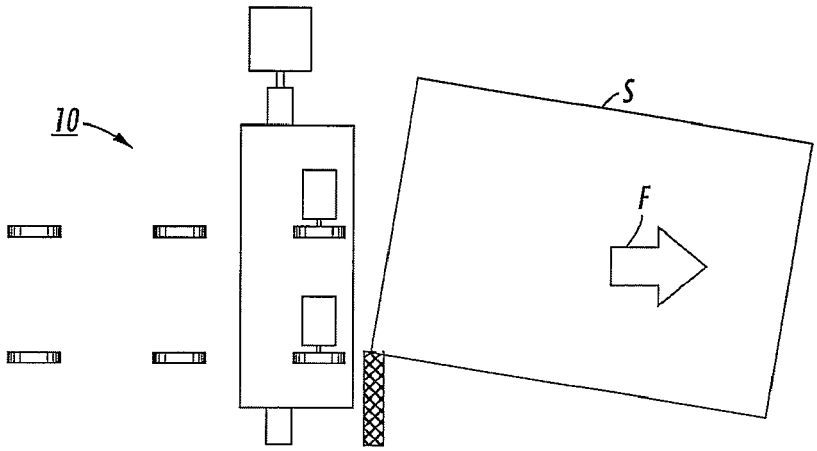

SYSTEMS AND METHODS FOR DETERMINING SKEW CONTRIBUTION IN LATERAL SHEET REGISTRATION

FIELD

This application relates to positioning of sheets in a feed path. It particularly relates to positioning sheets of paper in a feed path for subsequent processing.

BACKGROUND

FIG. 1 is a schematic illustration of a top plan view of a translating electronic registration system (TELER). Such systems are generally known in the art. See, for example, U.S. Pat. No. 5,094,442, herein incorporated by reference in its entirety.

The registration system 10 places a sheet S of media into proper alignment or registration for downstream processing as the sheet travels in the direction shown by arrow F. The registration unit 10 includes a carriage 12 having two drive rolls 14 and 16 rotatable mounted thereon by suitable means. The drive rolls 14 and 16 are driven by drive motors 18 and 20, respectively. The drive motors 18 and 20 are preferably speed controllable stepper motors, although other types of speed controllable servo motors are usable. The rotary output of each motor 18, 20 is transmitted to the respective drive roll 14, 16 by suitable power transmission means, such as shafts or belts.

Nip rolls (not shown) are mounted above drive rolls 14, 16 to engage the sheet S and drive it through the registration unit 10. The carriage 12 is mounted for movement transversely of the direction of feed indicated by arrow F. The carriage 12 is moved transversely of the feed path by a drive system including a speed controllable stepper motor 40 or other similar speed controllable servo motor. The output shaft of the motor 40, for example, drives a lead screw 42 connected to the carriage 12.

The registration system includes detectors for detecting the position of the sheet with respect to the registration system. Preferably, the sensors are optical detectors (photosensors) which will detect the presence of edges of the sheet S. For lead edge detection of the sheet, two sensors 48 and 50 are mounted on the carriage 12 adjacent the drive rolls 14 and 16 respectively. The detectors 48 and 50 detect the leading edge of the sheet S as it is drives past the sensors. The sequence of engagement of the sensors 48 and 50 and the amount of time between each detection is utilized to generate control signals for correcting skew (rotational mispositioning of the sheet about an axis perpendicular to the sheet) of the sheet S by variation in the speed of the drive rolls 14 and 16.

For lateral edge detection, a sensor 52 is suitably mounted and arranged on the registration unit 10 to generate control signals for correcting for lateral misregistration of the sheet S by moving the carriage 12.

Signals from the edge sensors 48, 50, 52 are provided to a controller 100. The controller 100 can be a typical microprocessor which is programmed to calculate correction values required and provide control outputs for effecting appropriate action of the stepper motors 18, 20 and 40. Such microprocessor control systems are well known to those of skill in the art and no detailed description thereof is necessary. Outputs of the microprocessor are provided controlling speeds and duration of drive of stepper motors 18, 20 and 40. Suitable driver control circuits are known in the art and no further detailed explanation is necessary.

A typical operating sequence for the registration system is as follows. For purposes of this analysis, the roll drive and translation motion are all assumed to take place with constant accelerations. The drive rolls 14 and 16 are initially driven at the same constant speed. The skew sensor 48 and 50 first detect the leading edge of the sheet S. Depending upon the direction of skew detected by sensors 48 and 50, the speed of roll 16 is increased or decreased, while the speed of roll 14 is correspondingly decreased or increased in the same time period. Once the skew position of the sheet has been achieved, the carriage translating motor 40 is driven to effect lateral edge positioning.

The sheet must also be laterally registered. This lateral registration is the result of first identifying where the sheet is and then moving the sheet laterally to some target edge location. The basic logic of lateral registration operation provides that, if the sensor 52 is covered by the sheet, the motor 40 will be controlled to move the carriage 12 laterally a distance that the sensor 52 is covered by the sheet S.

A difficulty lies in accurately identifying how the skew error of the sheet affects the lateral position during registration. For example, the drive rolls 14 and 16 may not be able to correct for skew entirely. As such, there still may be a very small skew error depending on the machine tolerances. Furthermore, as improvements upstream of the registration unit 10 decrease the initial lateral misregistration of the sheet, the lateral component of the skew error may become a more significant portion of the total error during lateral registration.

SUMMARY

According to one aspect of the invention, a method for compensating for the lateral component of skew in a registration system is provided. The method comprises: measuring edge positions of a skewed sheet of media using a sensor as the sheet passes the sensor; determining a lateral component of the skew based on said measured edge positions; and performing a lateral registration of the sheet including compensating for the lateral component of the skew.

According to another aspect of the invention, a method for compensating for the lateral component due to skew in a registration system is provided. The method comprises: determining a skew of a sheet of media; determining a lateral component of the skew; and performing a lateral registration process of the sheet including compensating for the lateral component of the skew.

According to a yet another aspect of the invention, a system for compensating for the lateral component due to skew in a registration system is provided. The system comprises: a device for determining a skew of a sheet of media; a translating electronic registration system; and a controller for compensating for a lateral component of the skew during a lateral registration move of the sheet.

Other objects, features, and advantages of one or more embodiments of the present invention will seem apparent from the following detailed description, and accompanying drawings, and the appended claims.

BRIEF DESCRIPTION OF THE DRAWINGS

Embodiments of the present invention will now be disclosed, by way of example only, with reference to the accompanying schematic drawings in which corresponding reference symbols indicate corresponding parts, in which:

FIG. 1 is a schematic illustration of a top plan view of a translating electronic registration system (TELER);

FIG. 2 illustrates an exemplary sheet of media having a skew;

FIGS. 3A-3C illustrate how the skew of the sheet may be determined, according to a first embodiment of the application;

DETAILED DESCRIPTION

Figure 4:
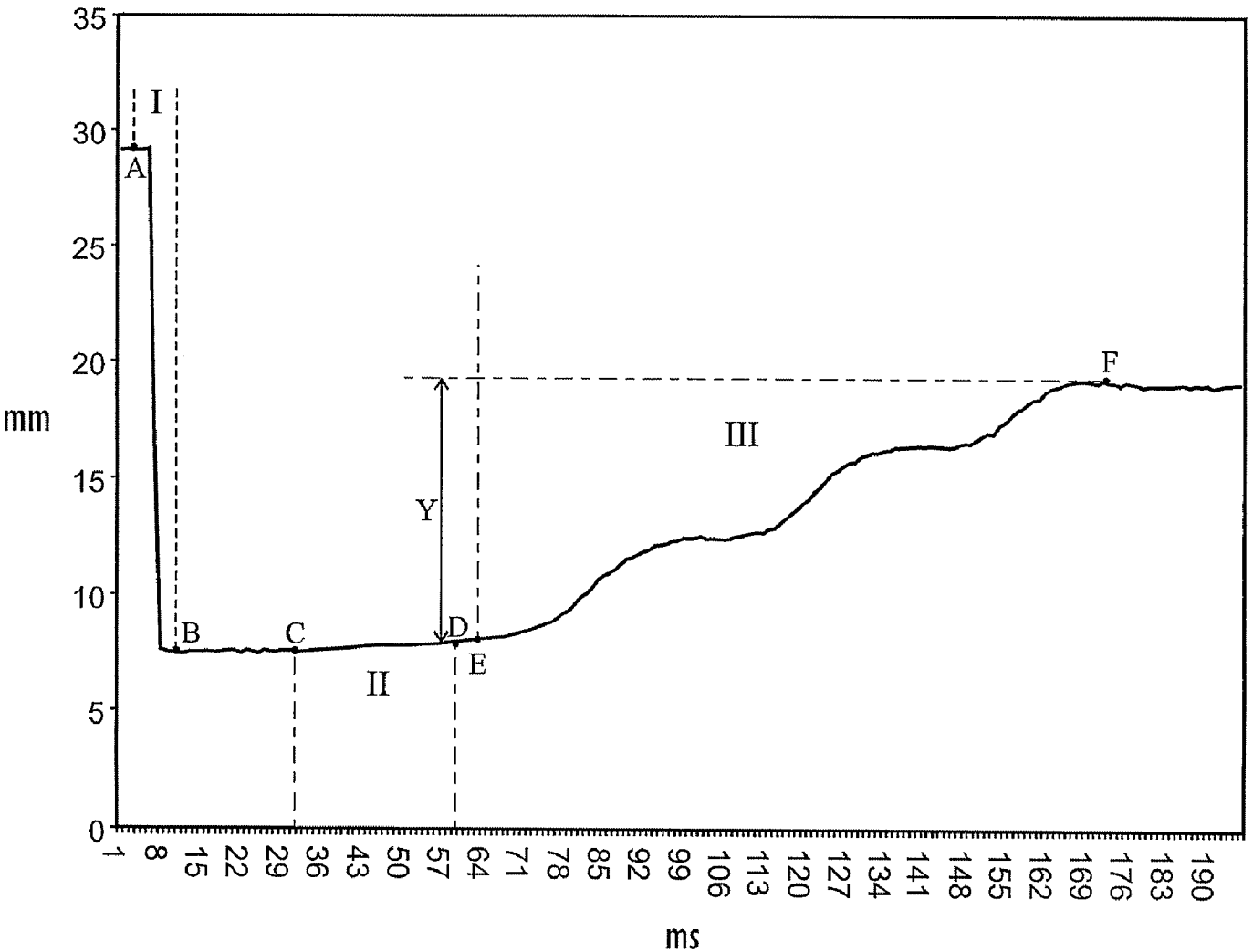
FIG. 4 illustrates a plot of the lateral edge sensor readings as a function of time during a lateral move using a translating electronic registration system, according to a first embodiment of the application.

Understanding the actual position of the sheet S before and during registration is complicated by any sheet skew. The skew of the sheet S has a corresponding lateral displacement component when the sheet is being measured by the lateral edge sensor.

The skew may include the initial incoming skew of the sheet entering the registration system 10 and prior to any deskewing operation.

In addition, the skew may include the residual skew error of the sheet subsequent to the deskewing operation. For example, the drive rolls 14 and 16 of the registration system 10 (FIG. 1) may not have been able to fully correct for the initial skew of the sheet S.

In either case, the sheet S will contain an inaccuracy equal to the lateral component of the skew.

FIG. 2 illustrates an exemplary sheet S having a skew at an angle Φ measured from the horizontal axis. It is noted that the dimensions in FIG. 2 have been exaggerated to better illustrate the skew and that a different skew may produce a different geometry. Further, while the a first lateral edge (bottom edge in figure) of the sheet S is shown with respect to the lateral edge sensor 52 it will be appreciated that the location of the lateral edge sensor 52 may be positioned at other locations with respect to the sheet S, such as at a second lateral edge (top edge in figure).

The sheet S may be any media having a length L and a width W oriented in an x-y plane. The x-direction and the y-direction may be also be referred to as the "process" and the "cross-process" directions, respectively. While the sheet S is shown oriented in the lengthwise direction ("portrait" orientation) in the figure, it will also be appreciated that the sheet S may be similarly oriented in the widthwise direction ("landscape" orientation).

The sheet S may be a standard 8½×11 inch letter paper or 8½×14 inch legal paper. However, it will be appreciated that other sizes and media types may similarly be used, such as, bond paper, parchment, cloth, cardboard, plastic, transparencies, film, or other print media substrates.

If no lateral move is made, any skew in the sheet S passing over the lateral edge sensor 52 will appear to have moved laterally a distance Δy in the y-direction over, for example, as measured from points $P_1$ and $P_2$ corresponding to the leading and trailing corners of the sheet S along the bottom edge of the sheet. To accurately position the sheet S, this lateral component Δy of the skew must be accounted for. According to one aspect of the application, the lateral component of the skew will be compensated for.

Assuming that the sheet S is perfectly square (or rectangular), the lateral component Δy of the skew may be calculated according to equation (1), as follows:

$$\Delta y = L_x * \tan \Phi \quad (1)$$

where:

$L_x$=horizontal projection of the sheet.

$L_x$ may be determined in a number of ways. For example, $L_x$ may be determined according to equation (2), as follows:

$$L_x = L * \cos \Phi \quad (2)$$

Alternatively, $L_x$ may be determined using empirical data from on-board sensors, such as, for example, a camera or multi-pixel photosensor. In one implementation, the difference between x-coordinates $X_{P1}$, $X_{P2}$ of points $P_1$ and $P_2$ as measured by the camera or multi-pixel photosensor may be used to determine $L_x$ according to equation (3), as follows:

$$L_x = X_{P1} - X_{P2} \quad (3)$$

Of course, it will be appreciated that other points on the leading and trailing edges (or other locations) of the sheet S that lie at the same lateral position might similarly be used.

In another implementation, assuming that the sheet S is traveling at a constant velocity, $V_x$ in the x-direction, the difference in time Δt that the leading and trailing edges of the sheet S are each detected by a sensor may be used. $L_x$ may be calculated according to equation (4), as follows:

$$L_x = V_x * \Delta t \quad (4)$$

It will be readily appreciated that other methodologies and means may similarly be used to determine $L_x$.

FIGS. 3A-3C illustrate an exemplary sheet S having a skew passing through a translating electronic registration system 10. The translating electronic registration system 10, for example, like the one shown in FIG. 1, may be used (although this need not be the case). For ease of illustration, elements of the registration system below the sheet S are shown in broken-line form and reference numerals corresponding to elements depicted in FIG. 1 have been omitted.

These figures shows a single skewed sheet S as it passes across a lateral edge sensor 52 from left to right with no lateral registration operation performed. The lateral edge sensor 52 may be photosensor, such as a multi-pixel photosensor, laser sensor, linear array or area sensor. In one implementation, the multi-pixel photosensor may be a charge-couple device (CCD).

Even without any lateral registration, the lateral edge sensor 52 will detect what appears to be lateral movement. This is because the sensor 52 is unable to distinguish the lateral component due to the skew from a lateral move performed by the translating electronic registration system 10. The present application, thus seeks to account for the additional lateral component caused by the skew.

FIG. 3A shows the skewed sheet S initially passing the lateral edge sensor 52. Approximately 20% of the sensor width is uncovered at this instance. As the skewed sheet S further passes over the sensor 52 more and more of the sensor 52 will be uncovered. FIG. 3B shows the sheet S after about half of the sheet S has passed the sensor 52. At this instance, only approximately 30% of the sensor width is covered. FIG. 3C shows the sheet S at the instance the trailing edge of the sheet S has nearly passed the sensor. The sensor is almost completely uncovered. Based on these sensor readings, it appears to the sensor 52, that the sheet S has "moved" approximately 80% of the sensor width as the sheet S passed the sensor 52. In actuality, though, the sheet S has not actually moved laterally. Rather, the sensor 52 has merely detected the lateral component of the skew.

FIG. 4 illustrates a plot of the lateral edge sensor readings as a function of time during a lateral move using a translating electronic registration system, according the first embodiment of the application. The sensor readings are measured in millimeters (mm) and the time is measuring in millisecond (ms) intervals. The sheet S arrives at the sensor from the left similar to as shown in FIG. 3A.

A reading from the lateral edge sensor 52 is taken at multiple time increments as the sheet S travels across it. A suitable controller may be provided for determining the start and end (e.g., points A-F) for each of the regions I, II, and III of the plot illustrated in FIG. 4. Region I of the plot shows the sheet S initially crossing the lateral edge sensor 52. Region II of the plot shows the sheet S as it continues to pass the lateral edge sensor 52, and Region III of the plot shows a lateral registration process. For example, the start and end of each of the regions maybe dictated by thresholds values, and/or thresholds of derivative values thereof. While the figure shows distinct points for the start and end of end region, it will be appreciated that the end and start for adjacent regions could be the same.

At point A, in Region I, the lateral edge sensor 52 is fully exposed and producing a maximum sensor reading (28 mm). Once the sheet S passes over the sensor, the sheet quickly covers a substantial portion of the width of the sensor 52 in a relatively short time frame (see, e.g., FIG. 3A) This results in the near vertical drop-off of the sensor reading at point B (shown at about 7.5 mm). The lateral edge of the sheet S is thus detected. If the target edge location for the sheet S is 19 mm, the controller would ordinarily determine that a lateral misregistration of 11.5 mm (i.e., target edge location of 19 mm less the initial lateral edge sensor reading of 7.5) is to be compensated for. However, as discussed above, this estimated distance fails to account for the lateral component of the skew.

Region II of the plot shows the sheet S as it further progresses. (see, e.g., FIGS. 3B-3C). Between points C and D, the sensor 52 readings are substantially linear in this region. The slope of the sensor 52 readings in this region indicates the skew of the sheet S.

The slope of the sensor readings in Region II may be determined using a suitable curve-fitting technique. In one implementation, a linear regression algorithm may be used to detect the slope in Region II. It will be appreciated that other curve fitting techniques may also be used, such as, for example, a simple averaging formula over a given time frame (e.g., rise/run) in region II. The sheet S may only need to cross the lateral edge sensor 52 a few millimeters in the x-direction, for example, to detect the slope. It will also be appreciated that the slope may be continuously monitored in other regions, such Region III and/or thereafter.

The tangent function for a line at a given angle is equal to the slope of that line. Thus, once the slope of the region II is determined, the tangent of the skew angle. Φ may be determined according to equation (5), as follows:

$$\tan \Phi = \text{slope} \tag{5}$$

By using a lateral edge sensor 52 installed on a translating electronic registration system, the effect of the lateral component Δy of the skew may be accurately accounted for, according to equation (1), above. Inserting equation (5) into equation (1), yields equation (6), as follows:

$$\Delta y = L_x * \text{slope} \tag{6}$$

Depending on the skew of the sheet S, the slope of the regression line may be positive or negative. For example, for the lateral edge sensor configuration shown in FIGS. 3A-3C, a positive slope indicates that the leading corner $P_1$ of the sheet is lower than the trailing corner $P_2$. Conversely, a negative slope indicates that the trailing corner $P_2$ of the sheet would be lower than the leading corner $P_2$. Of course it will be appreciated that the orientation of the lateral edge sensor with respect to the registration system will dictate whether the skew will be positive or negative.

The lateral component Δy, introduced by the skew, may advantageously be compensated for. In one implementation, the lateral component Δy of the skew may be subtracted from (or added to) the estimate registration motion to get a better approximation of the actual lateral registration necessary.

Region III of the plot shows a lateral registration process. The lateral registration process may start at point E and end at point F, for example, after lateral registration process. Since the sheet S is still partially covering the lateral edge sensor 52 at this instance the sensor reading for point F is not equal to point A. In one implementation, a deskewing process may also be performed within this region, during, after or contemporaneous with the lateral registration process (if so, then the slope, for example, after point F may be essentially zero). In FIG. 4, Y is the difference in the lateral edge sensor readings before and after the lateral registration process of Region III.

The lateral registration may include multiple "steps" or moves of the carriage 12 (FIG. 1) in completing the lateral registration move. As shown in Region III of the plot, a lateral registration move may be made in three small lateral moves. It will be appreciated that the lateral registration may be completed in more or less moves as provided by the controller of the registration system.

The lateral component Δy introduced by the skew may be subtracted out of the estimated lateral registration movement determined the controller, according to equation (7), as follows:

$$D_y' = D_y - \Delta y \tag{7}$$

where:

$D_y'$=the compensated lateral distance the sheet is to be moved; and $D_y$=the estimated lateral distance that the sheet is to be moved.

Thus, according to one exemplary scenario, if the controller determines $D_y$ to be 11.5 mm (i.e., target edge location of 19 mm less the initial lateral edge sensor reading of 7.5) and the lateral component Δy of the skew is determined to be 1.2 mm, then the actual lateral distance the sheet is to be moved $D_y'$ will be 10.3 mm. The lateral registration then commences using $D_y'$ instead of $D_y$. Similarly, the difference in the lateral edge sensor readings before and after the lateral registration Y should be equal $D_y'$.

Without any correction, the difference in the lateral edge sensor readings before and after the lateral registration Y generally would be equal $D_y$. However, this value is erroneous as it includes a lateral component of the skew.

In some implementations, the lateral component Δy introduced by the skew may be used control the deskewing operation of the TELER. The lead edge detection sensors 48, 50 (FIG. 1) may be eliminated, for example, from the TELER system altogether, by using a single lateral edge sensor 52 to detect skew. In addition, in some implementations, Δy may be used as a feedback and/or feedforward error signal to the controller to more precisely control the deskewing operation, depending on the controller architecture.

Figure 5A:
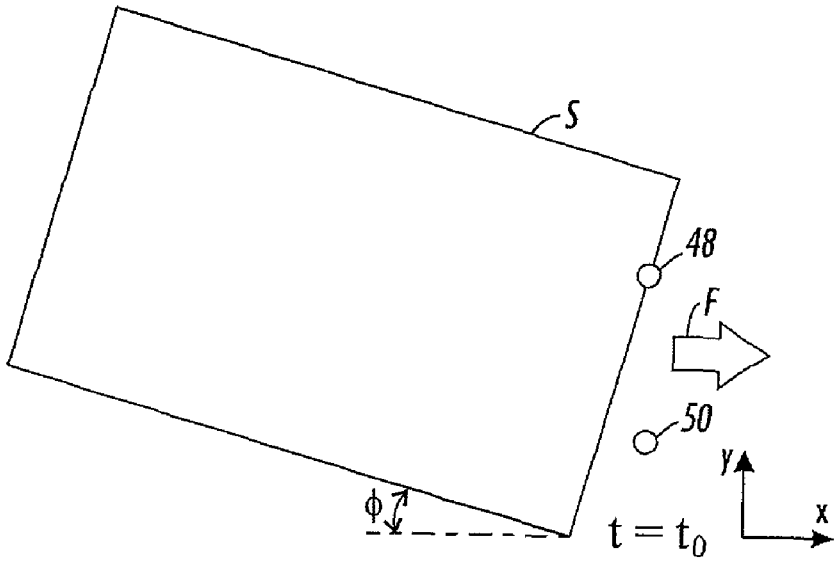
FIGS. 5A-5B illustrate how the skew of the sheet may be determined, according to a second embodiment of the application.
Figure 5B:
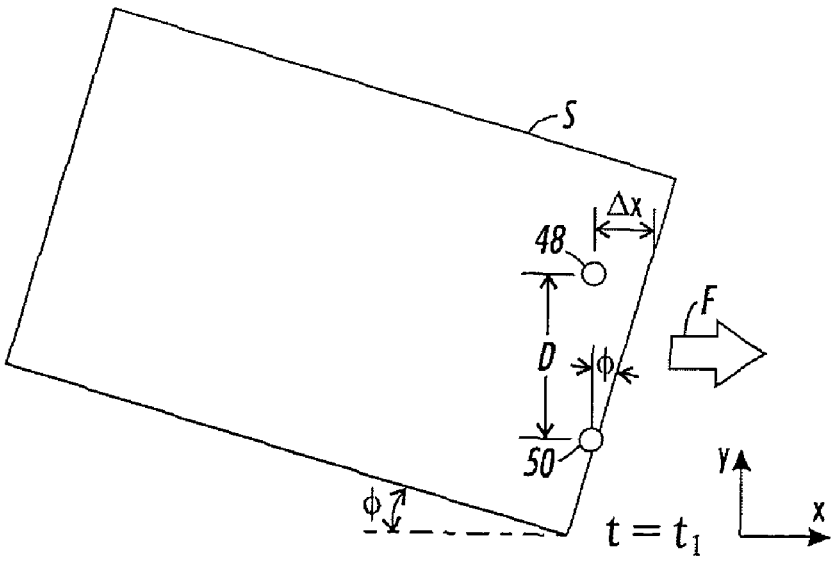

FIGS. 5A-5B illustrates how the skew of the sheet S may be determined according to a second embodiment of the application. The skew of the sheet S may be determined using a pair of lead edge sensors 48, 50 of a translating electronic registration system 10 (FIG. 1). FIG. 5A shows a first of the lead edge sensors 48, 50 detecting the leading edge of the sheet S at a time $t_0$. In this example, the top sensor 48 will detect the leading edge of the sheet S first. FIG. 5B shows at a later time $t_1$ the bottom sensor 50 detecting the leading edge of the sheet S.

Based on the geometry of the lead edges sensors 48, 50 and the distance that the sheet S has traveled between times $t_0$ and $t_1$, the relationship of the skew angle may be determined according to equation (8), as follows:

$$\tan \Phi = \Delta x / D \tag{8}$$

where:

Δx=the distance traveled by the sheet S in the x-direction between times $t_0$ and time $t_1$; and D=the lateral spacing between the pair of lead edge sensors.

Assuming that the sheet S is traveling at a constant speed, $V_x$ in the x-direction, then the distance that the sheet S has moved in the x-direction between times $t_0$ and $t_1$ may be calculated according to equation (9), as follows:

$$\Delta x = V_x * (t_1 - t_0) \tag{9}$$

Alternatively, the skew may also be determined by other methodologies and means. For example, it will be appreciated that the skew angle Φ of the sheet S may be calculated using a skew sensor or camera. The Xerox iGen3® digital printing press, for example, includes a registration system that uses dedicated skew sensors. See also U.S. Pat. No. 4,776,027, herein incorporated by reference in its entirety, which discloses determining a skew angle using a camera.

This application demonstrates an improved methodology for identifying the skew on a sheet S. In addition, the benefits of the improved measurement method may be used to improve the registrations system's ability to identify the effect of the skew and compensate for lateral component thereof during a lateral registration move.

A controller, such as controller 100 (FIG. 1) may be configured to compensate for the lateral component of the skew. Once the estimated lateral registration movement of the sheet S is determined, the lateral component of the skew may be subtracted from (or added to) this value. The lateral registration then begins using the compensated value.

In one implementation, the skew and lateral registration operations may be performed substantially simultaneously. In the conventional TELER system, the deskewing operation was performed separately from the lateral registration operation his application proposes to complete the two operations at the same time. For example, the incoming skew of the sheet S may be determined according to one or more of the embodiments disclosed herein. Knowing the incoming skew of the sheet, the lateral component of the incoming skew may be determined. This value may be subtracted from (or added to) the estimated lateral registration movement for lateral registration. The deskewing operation may advantageously occur at the same time.

In another implementation, the residual error after a deskewing operation may be accounted for during a subsequent lateral registration process. For example, once the deskewing operation is completed, the skew error of the sheet S may be determined according to one or more of the embodiments disclosed herein. Knowing the skew error of the sheet, the lateral component of the skew error may be determined. This value may be subtracted from (or added to) the estimated lateral registration movement for lateral registration. The lateral registration operation may then proceed. Moreover, the lateral component of the skew error may be used to further control deskewing operations to correct for any residual errors thereof.

The controller is provided to control the translating electronic registration system and to compensate for the lateral component of skew. It may be dedicated hardware like ASICs or FPGAs, software, or a combination of dedicated hardware and software. For the different applications of the embodiments disclosed herein, the programming and/or configuration may vary.

While this invention has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the invention following, in general, the principles of the invention and including such departures from the present disclosure as come within known or customary practice in the art to which the invention pertains, and as may be applied to the essential features hereinbefore set forth and followed in the spirit and scope of the appended claims.

What is claimed is:

1. A method for compensating for the lateral component of skew in a registration system:

measuring edge positions of a skewed sheet of media using a sensor as the sheet passes the sensor;

determining a lateral component of the skew based on said measured edge positions; and performing a lateral registration of the sheet including compensating for the lateral component of the skew, wherein compensating for the lateral component of the skew comprises subtracting the lateral component of the skew from an estimated lateral distance the sheet is to be moved.

2. The method according claim 1, wherein measuring edge positions of the skewed sheet comprises measuring the lateral edge position of the sheet using a lateral edge sensor.

3. The method according claim 1, wherein measuring edge positions of the skewed sheet comprises measuring the lead edge position of the sheet using a pair of lead edge sensors.

4. The method according to claim 1, wherein determining a lateral component of the skew based on said measured edge positions comprises determining the linear regression of the function characterizing the edge of the sheet as it passes an edge detection sensor.

5. The method according to claim 1, wherein determining the lateral component of the skew is performed according to the following equation:

$$\Delta y = L_x * \tan \phi$$

where:

Δy=lateral component of the skew of the sheet;

Φ=the skew angle of the sheet; and $L_x$=horizontal projection of the length of the sheet.

6. The method according to claim 5, where $L_x$ is determined according to the following equation:

$$L_x = L * \cos \Phi.$$

7. The method according to claim 5, where $L_x$ is determined using a camera or a multi-pixel photosensor.

8. The method according to claim 5, wherein $L_x$ is determined according to the following equation:

$$L_x = V_x * \Delta t$$

where:

$V_x$=the velocity of the sheet in the process direction;

Δt=the difference in time that a leading edge and the trailing edge of the sheet cross a sensor.

9. The method according to claim 1, wherein the sensor is an linear array or an area sensor.

10. The method according to claim 1, wherein the lateral registration of the sheet is performed in a plurality of steps.

11. The method according to claim 1, wherein the skew is a residual skew error after a deskewing operation or an incoming skew of a sheet prior to any deskewing operation.

12. A method for compensating for the lateral component of skew in a registration system:

measuring edge positions of a skewed sheet of media using a sensor as the sheet passes the sensor;

determining a lateral component of the skew based on said measured edge positions; and performing a lateral registration of the sheet including compensating for the lateral component of the skew, wherein a deskewing operation and the lateral registration operation are performed and completed substantially simultaneously.

13. A method for compensating for the lateral component due to skew in a registration system:

determining a skew of a sheet of media;

determining a lateral component of the skew; and performing a lateral registration process of the sheet including compensating for the lateral component of the skew, wherein compensating for the lateral component of the skew corn prises subtracting the lateral component of the skew from an estimated lateral distance the sheet is to be moved.

14. The method according to claim 13, wherein determining the skew of the sheet of media comprises determining the slope of a function characterizing the edge positions of the sheet as it passes a lateral edge sensor.

15. The method according to claim 13, wherein determining the skew of the sheet of media comprises determining the respectively times that the leading edge of the sheet passes each of a pair of lead edge sensors.

16. The method according to claim 13, wherein determining the skew of the sheet of media comprises using a camera or a multi-pixel photosensor.

17. The method according to claim 13, wherein a deskewing operation and the lateral registration operation are performed substantially simultaneously.

18. A system for compensating for the lateral component due to skew in a registration system:

a device for determining a skew of a sheet of media;

a translating electronic registration system; and a controller for compensating for a lateral component of the skew during a lateral registration move of the sheet wherein the controller is configured to compensate for the lateral component of the skew comprises subtracting the lateral component of the skew from an estimated lateral distance the sheet is to be moved.

19. The system according to claim 18, wherein the translating electronic registration system performs lateral registration of the sheet in a plurality of steps.

20. The system according to claim 18, wherein the device for determining a skew of a sheet of media comprises a lateral edge sensor.

21. The system according to claim 18, wherein the device for determining a skew of a sheet of media comprises a pair of lead edge sensors.

22. The system according to claim 18, wherein the device for determining a skew of a sheet of media comprises a camera or a multi-pixel photosensor.

23. The system according to claim 18, wherein the controller is configured to perform a deskewing operation and the lateral registration operation substantially simultaneously.

* * * * *